US012546526B2

(12) United States Patent
Shin

(10) Patent No.: US 12,546,526 B2
(45) Date of Patent: Feb. 10, 2026

(54) STRUCTURE OF FIXING SPOUT AND NUGGET ICE MAKER APPLYING IT

(71) Applicant: BLUENIX Co., Ltd., Gyeonggi-do (KR)

(72) Inventor: Seung Jin Shin, Gyeonggi-do (KR)

(73) Assignee: Bluenix Co., Ltd (KR)

( * ) Notice: Subject to any disclaimer, the term of this patent is extended or adjusted under 35 U.S.C. 154(b) by 64 days.

(21) Appl. No.: 18/536,846

(22) Filed: Dec. 12, 2023

(65) Prior Publication Data

US 2025/0067493 A1 Feb. 27, 2025

(30) Foreign Application Priority Data

Aug. 22, 2023 (KR) ..... 10-2023-0110015

(51) Int. Cl.
*F25C 5/20* (2018.01)

(52) U.S. Cl.
CPC ..... *F25C 5/24* (2018.01); *F25C 2400/04* (2013.01)

(58) Field of Classification Search
CPC ..... F25C 5/24; F25C 2400/04; F25C 5/22
See application file for complete search history.

(56) References Cited

U.S. PATENT DOCUMENTS

| | | | | |
|---|---|---|---|---|
| 9,733,004 | B2 * | 8/2017 | Mitchell | F25C 5/187 |
| 2006/0277937 | A1 * | 12/2006 | Schlosser | F25C 5/20 62/340 |
| 2011/0049190 | A1 * | 3/2011 | Sevcik | F25C 5/20 222/63 |

FOREIGN PATENT DOCUMENTS

| | | | |
|---|---|---|---|
| JP | 05-090851 | | 12/1993 |
| JP | H06249557 | A * | 9/1994 |
| JP | 2011-185447 | | 9/2011 |
| JP | 2011-185450 | | 9/2011 |
| JP | 2013-221698 | | 10/2013 |

OTHER PUBLICATIONS

JPH06249557 English Translation (Year: 1994).*

* cited by examiner

*Primary Examiner* — David J Teitelbaum
(74) *Attorney, Agent, or Firm* — The Farrell Law Firm, P.C.

(57) ABSTRACT

A structure of fixing a spout facilitating fixing and assembling a spout and a nugget ice maker applying the same are provided. The structure of fixing a spout includes a spout provided between an ice producing unit and an ice storage unit, and delivering ice produced by the ice producing unit to the ice storage unit; a flange provided on a side to which the ice producing unit and the spout are connected, and having locking portions respectively convexly formed on both sides; and a fixing wire having both ends locked by the locking portion and rotating around the locking portion to fix the spout to the flange.

8 Claims, 7 Drawing Sheets

FIG. 2 ( a )

STRUCTURE OF FIXING SPOUT AND NUGGET ICE MAKER APPLYING IT

CROSS-REFERENCE TO RELATED APPLICATION(S)

This application claims the benefit of a priority to Korean Patent Application No. 10-2023-0110015 filed on Aug. 22, 2023, in the Korean Intellectual Property Office, the entire disclosure of which is incorporated herein by reference for all purposes.

BACKGROUND

The present disclosure discloses a structure of fixing a spout and a nugget ice maker applying the same.

An ice maker is a device producing ice and supplying the ice to a user.

In general, an auger-type ice maker draws a cold refrigerant into a refrigerant pipe on an outer wall of a cylinder, causing the water inside the cylinder to freeze and produce thin ice on the inner wall of the cylinder, and the ice produced at this time is scraped off as an auger rotates, is transported to an upper portion thereof, and is compressed and cut. Thereafter, the ice produced is delivered to a storage tank and stored.

A spout is a portion discharging ice produced by the ice producing unit, which collects the ice produced, turns a direction, and transfers the ice to the storage tank. In this case, a certain level of force is continuously applied to the spout in an upward direction, so the spout should be firmly fixed to withstand the force, and at the same time, it is a portion in which the produced ice is directly contacted and transmitted, so that hygiene management is also important. Meanwhile, the spout easily forms limescale, and thus should be removed and cleaned periodically after use for a certain period of time, so ease of assembly is also an issue.

SUMMARY

The present invention is intended to solve the above-described problems, and an aspect of the present disclosure is to provide a structure of fixing a spout facilitating fixing and assembling a spout and a nugget ice maker applying the same.

In order to achieve the above-described object, an aspect of the present disclosure is to provide a structure of fixing a spout and a nugget ice maker applying the same as follows.

According to an aspect of the present disclosure, provided is a structure of fixing a spout, the structure of fixing a spout including: a spout between an ice producing unit and an ice storage unit, and delivering ice produced by the ice producing unit to the ice storage unit, a flange provided on a side to which the ice producing unit and the spout are connected, and having locking portions, respectively convexly formed on both sides, and a fixing wire having both ends locked by the locking portion and rotating around the locking portion to fix the spout to the flange.

In an embodiment, the spout may include a cover portion fixed to be in contact with the fixing wire and a passage portion coupled to the cover portion, and connecting the ice producing unit and the ice storage unit.

In an embodiment, the passage portion may include a discharge hole formed to communicate with the ice producing unit, and through which ice produced by the ice producing unit is discharged, a delivery hole formed to communicate with the ice storage unit and delivering the ice discharged through the discharge hole to the ice storage unit, and an ice delivery surface formed to be inclined downwardly from one surface of the discharge hole toward the delivery hole.

In an embodiment, the cover portion may include a first reinforcing rib protruding in a direction parallel to the direction in contact with the fixing wire.

In an embodiment, the cover portion may further include a second reinforcing rib intersecting the first reinforcing rib, and a seating groove may be formed in a portion in which the first reinforcing rib and the second reinforcing rib intersect.

In an embodiment, the first reinforcing rib and the second reinforcing rib may intersect vertically.

In an embodiment, the locking protrusion may include a first locking protrusion formed to protrude in a radial direction of the flange and a second locking protrusion formed to be bent from one end of the first locking protrusion.

In an embodiment, the fixing wire may include a locking hole provided at both ends of the fixing wire, and formed to surround the first locking protrusion.

In an embodiment, provided is a nugget ice maker, the nugget ice maker including: an ice producing unit exchanging heat with a refrigerant to produce ice; an ice storage unit storing ice produced by the ice producing unit; and the above-described structure of fixing a spout connecting the ice producing unit and the ice storage unit.

In an embodiment, the ice producing unit may include a hollow cylinder, an auger provided inside the cylinder, coaxially with the cylinder, and a refrigerant pipe formed to surround an outer peripheral surface of the cylinder.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
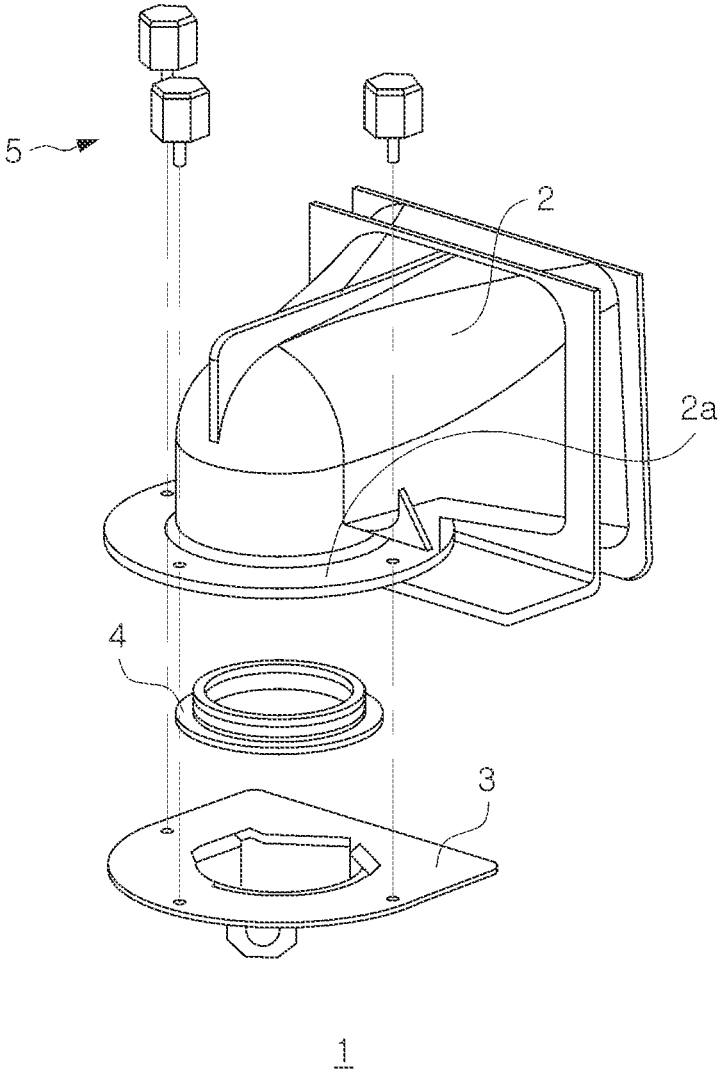
FIG. 1 is an exploded view illustrating a conventional structure of fixing a spout.

Hereinafter, preferred embodiments of the present disclosure will be described in detail so that those skilled in the art could easily practice the present disclosure with reference to the accompanying drawings. However, the spirit of the present disclosure is not limited to the present embodiments, and those skilled in the art who understand the spirit of the present disclosure may easily suggest other regressive inventions or other embodiments included within the scope of the present disclosure by adding, changing, or deleting other components within the scope of the same spirit, but it will also be said that this is included within the scope of the inventive idea of the present application.

In addition, throughout the specification, when a portion is said to be 'connected' to another portion, this is not only when it is 'directly connected,' but also when it is 'indirectly connected' with other components therebetween. In addition, 'including' a certain component means that other components may be further included without excluding other components unless otherwise stated.

In addition, components having the same function within the scope of the same idea shown in the drawings of each embodiment will be described using the same reference numerals.

FIG. 1 illustrates a conventional structure of fixing a spout 1.

As illustrated in FIG. 1, the conventional structure of fixing a spout 1 includes a spout 2, a flange 3, a packing member 4, and a plurality of fastening members 5, and the spout 2 and the flange 3 are coupled through the plurality of fastening members 5, and the packing member is inserted therebetween.

The spout 2 is a portion which is in direct contact with the produced ice and easily forms limescale, so it should be separated and cleaned periodically after use for a certain period of time, but there is a problem in that it is difficult to be disassembled and assembled since the spout 2 is fixed through the plurality of fastening members 5. In addition, when using the plurality of fastening members 5, the plurality of fastening members 5 may be damaged due to corrosion or the like due to dew condensation or water leakage. In particular, there is a problem in that a spout flange 2*a* to which the plurality of fastening members 5 are coupled may be easily damaged by the force of the produced ice being discharged.

In addition, in the case of a spout assembly structure (not shown) that does not use a fastening member, there is a problem in that the produced ice cannot withstand the force of ice being discharged and the spout may deviate, causing product failure.

The present disclosure has recognized the above problems, and an aspect of the present disclosure is to provide a structure of fixing a spout facilitating fixing and assembling a spout, and a nugget ice maker applying the same.

Figure 2B:
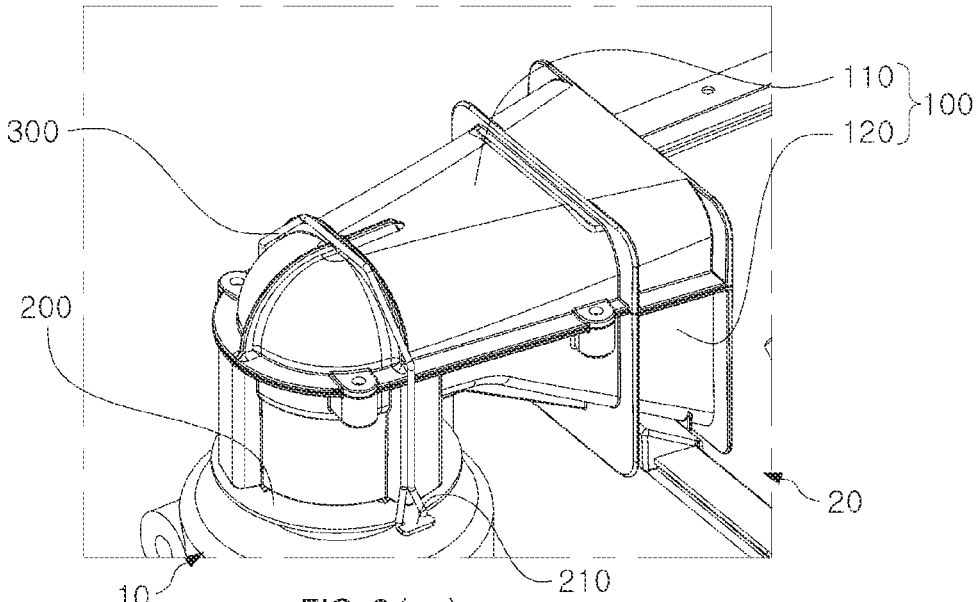
FIG. 2(*a*) is a perspective view illustrating a structure of fixing a spout according to an embodiment of the present disclosure after a spout is fixed, and FIG. 2(*b*) is a perspective view illustrating a structure of fixing a spout according to an embodiment of the present disclosure after a spout is separated.
Figure 2B:
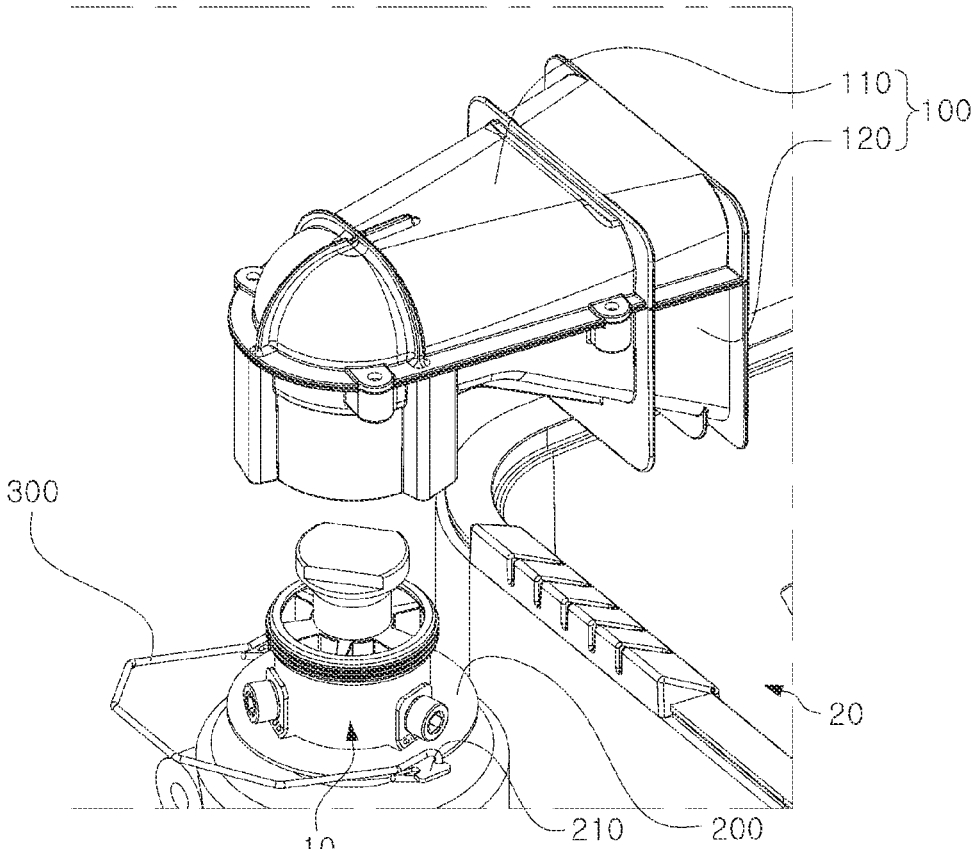

FIG. 2 is a perspective view of a structure of fixing a spout according to an embodiment of the present disclosure. More specifically, FIG. 2(*a*) illustrates a state in which a spout is fixed, and FIG. 2(*b*) illustrates a state in which a spout is disassembled. Referring to FIG. 2, the structure of fixing a spout according to an embodiment of the present disclosure includes a spout 100, a flange 200, and a fixing wire 300. The spout 100 is provided between an ice producing unit 10 and an ice storage unit 20, and delivers the ice produced by the ice producing unit 10 to the ice storage unit 20. The flange 200 is provided on a side to which the ice producing unit 10 and the spout 100 are connected, and a locking portion 210 may be formed convexly on both sides. Both ends of the fixing wire 300 may be locked by the locking portion 210, and the spout 100 may be fixed to the flange 200. That is, the fixing wire 300 may rotate around the locking portion 210 to fix or separate the spout 100. For example, the locking portion 210 can function as a hinge.

Therefore, according to the structure of fixing a spout according to an embodiment of the present disclosure, since the spout 100 may be easily fixed or separated by the fixing wire 300 in one-touch manner, the spout 100 is easily assembled, and even when the interior of the spout 100 is periodically cleaned, it can be easily disassembled and assembled by hand without any special tools.

Figure 3:
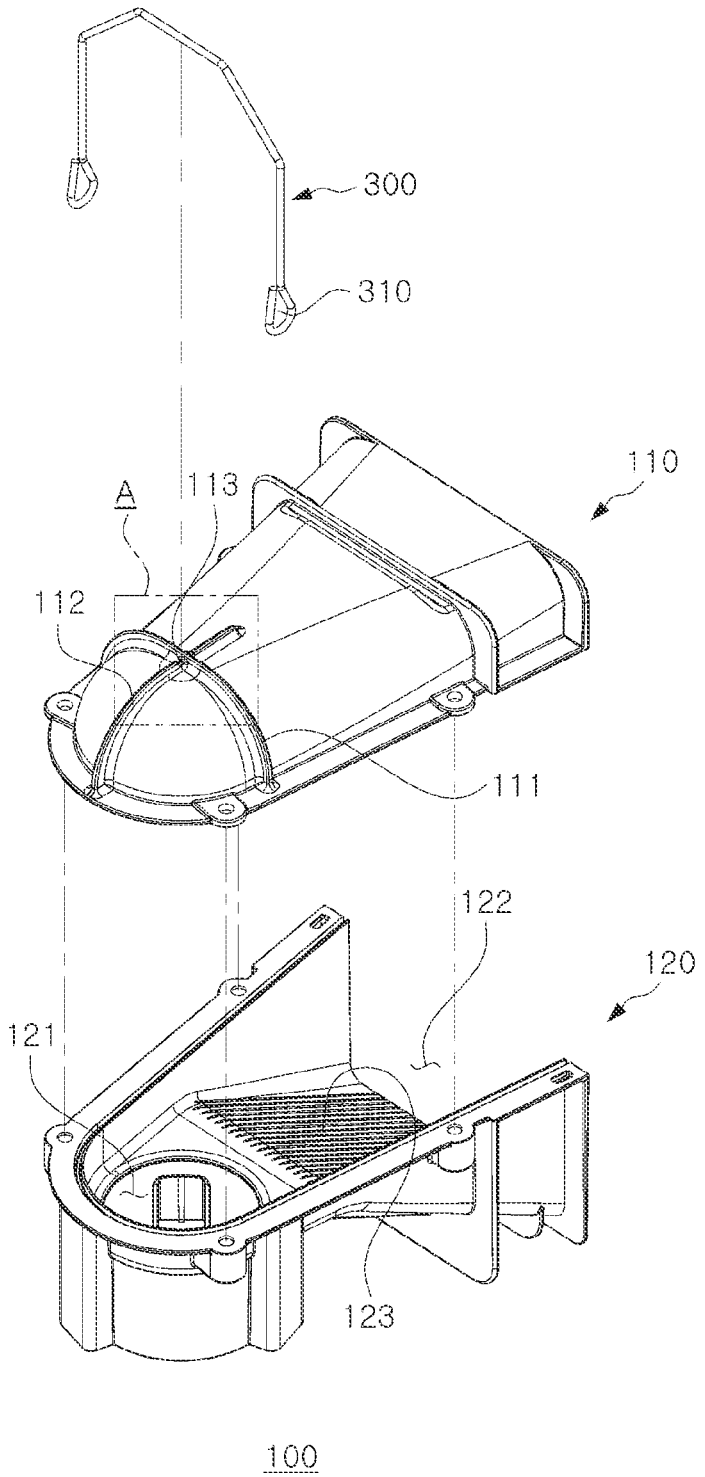
FIG. 3 is an exploded view of a spout and a fixing wire according to an embodiment of the present disclosure.
Figure 4:
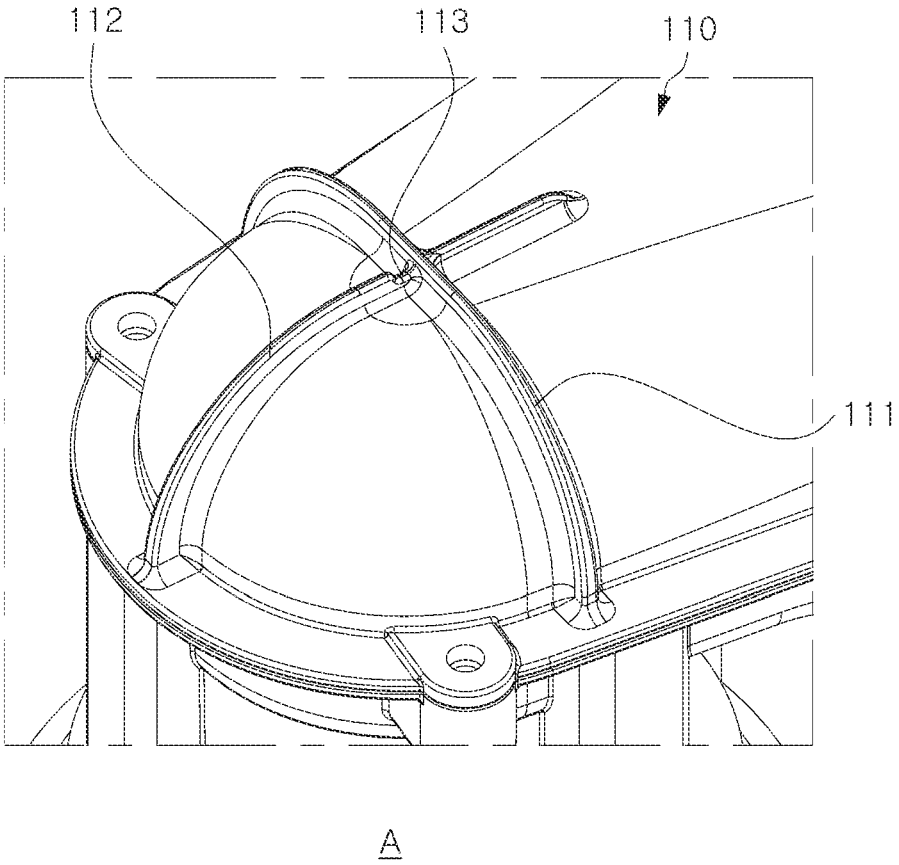
FIG. 4 is an enlarged view of portion A of FIG. 3.
Figure 5:
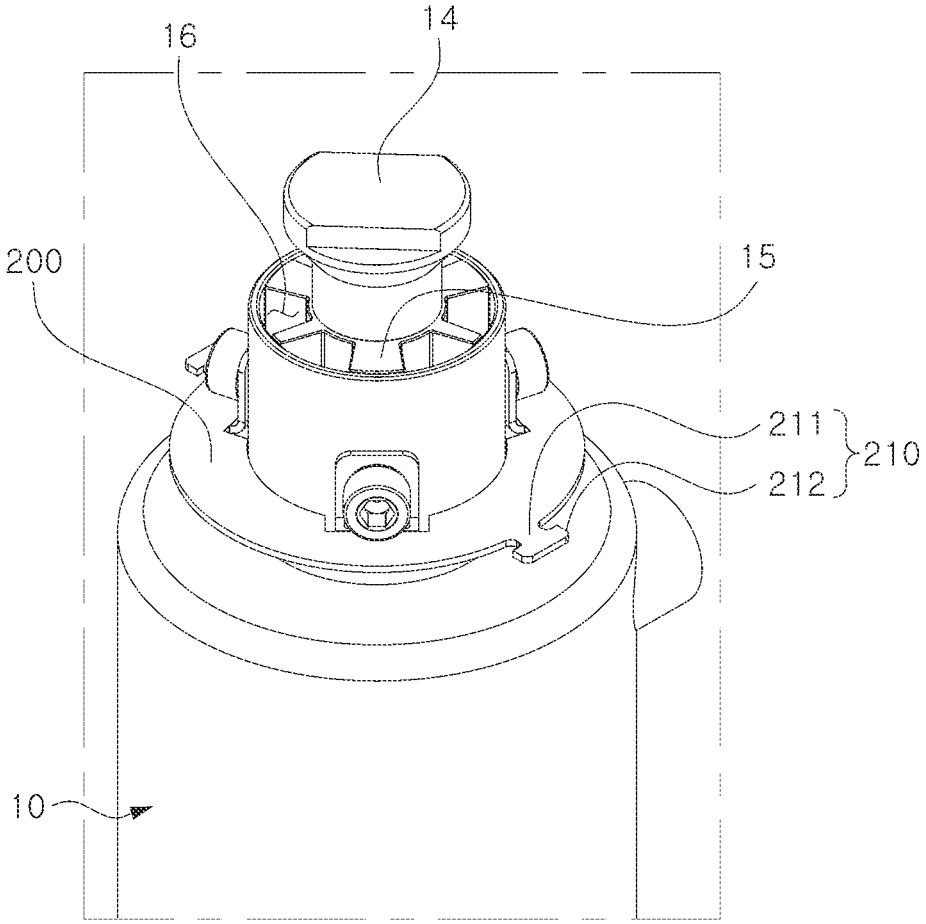
FIG. 5 is a perspective view of an ice producing unit to which a flange is applied according to an embodiment of the present disclosure.

FIGS. 3 to 5 illustrate a structure of fixing a spout according to an embodiment of the present disclosure in more detail. FIG. 3 is an exploded view of a spout and a fixing wire according to an embodiment of the present disclosure, FIG. 4 is an enlarged view of portion A of FIG. 3, and FIG. 5 is a perspective view illustrating a flange according to an embodiment of the present disclosure. Hereinafter, a structure of fixing a spout according to an embodiment of the present disclosure will be described with reference to FIGS. 3 to 5.

A spout 100 according to an embodiment of the present disclosure includes a cover portion 110 and a passage portion 120. The cover portion 110 is fixed to be in contact with the fixing wire 300, and the passage portion 120 is coupled to the cover portion 110 and connects the ice producing unit 10 and an ice storage unit 20 (see FIG. 6).

The cover portion 110 may include a first reinforcing rib 111 protruding in a direction, parallel to the direction in contact with the fixing wire 300. The first reinforcing rib 111 may have a shape corresponding to the fixing wire 300 and, for example, may have an arch shape along the shape of the cover portion 110 having a curvature.

In addition, the cover portion 110 may further include a second reinforcing rib 112 intersecting the first reinforcing rib 111, and in this case, a seating groove 113 may be formed in a portion in which the first reinforcing rib 111 and the second reinforcing rib 112 intersect. In this case, a formation position of the seating groove 113 is not limited as long as it is a portion in which the first reinforcing rib 111 and the second reinforcing rib 112 intersect. In addition, although not illustrated in the drawings, the first reinforcing rib 111 may be integrally formed with a groove (not shown), and the fixing wire 300 may be seated in a groove (not shown) formed in the first reinforcing rib 111. In this case, the first reinforcing rib 111 and the second reinforcing rib 112 may intersect each other vertically, thereby easily preventing the fixing wire 300 from being separated.

The passage portion 120 may include a discharge hole 121 formed to communicate with the ice producing unit 10, and through which ice produced by the ice producing unit 10 is discharged, a delivery hole 122 formed to communicate with the ice storage unit 20 (see FIG. 6), and delivering ice discharged through the discharge hole 121 toward the ice storage unit 20 (see FIG. 6), an ice delivery surface 123 formed to be inclined downwardly from one surface of the discharge hole 121 toward the delivery hole 122.

For example, as illustrated in FIG. 5, in the case of an auger-type ice maker, ice produced through the ice producing unit 10 may be cut by the cutter 14 and discharged in a direction, parallel to a height direction through an ice discharge space 16. In this case, the produced ice is discharged to the passage portion 120 through the discharge hole 121, and the ice flowing into the passage portion 120 is delivered to a side of the ice storage unit 20 (see FIG. 6) through the delivery hole 122. In this case, as the ice delivery surface 123 is formed to be inclined downwardly, it can facilitate the delivery of ice toward the ice storage unit 20 (see FIG. 6).

In addition, the locking portion 210 formed on the flange 200 according to an embodiment of the present disclosure may include a first locking protrusion 211 and a second locking protrusion 212. The first locking protrusion 211 may be formed to protrude in a radial direction of the flange 200, and the second locking protrusion 212 may be formed to be bent to prevent the fixing wire 300 from being separated from one end of the first locking protrusion 211. For example, the first locking protrusion 211 and the second locking protrusion 212 may protrude from the flange 200 in the radial direction of the flange 200 in a '⊥' shape.

In this case, the fixing wire 300 may include a locking hole 310 provided at both ends, and formed to surround the first locking protrusion 211. As a result, when the fixing wire 300 is fixed to the spout 100, the locking hole 310 may be fixed to be locked by the first locking protrusion 211 and the second locking protrusion 212, and the fixing wire 300 can be prevented from being separated from the flange 200. Meanwhile, when the fixing wire 300 is separated from the spout 100, the locking hole 310 may be separated from the first locking protrusion 211 and the second locking protrusion 212. That is, the size of the locking hole 310 is not limited as long as it is fixed to be locked and cannot be separated when the spout is fixed, and the size of the locking hole 310 is not limited as long as it may be separated from the first locking protrusion 211 and the second locking protrusion 212 when the spout is separated.

That is, according to the structure of fixing a spout according to an embodiment of the present disclosure, since the interior of the spout 100 may be easily cleaned through assembly and disassembly of the cover portion 110 and the passage portion 120, thereby solving hygiene issues. In addition, the ice produced by the ice producing unit 10 may be discharged through the first reinforcing rib 111, and the force pushing the cover portion 110 may be distributed, and as a fixing wire 300 is disposed in a portion in which the first reinforcing rib 111 and the second reinforcing rib 112 intersect, it is possible to prevent the fixing wire 300 from being separated, and at the same time, the first locking protrusion 211 and the second locking protrusion 212 may fix and lock or separate both ends of the fixing wire 300 depending on a fixed state of the spout 100.

Figure 6:
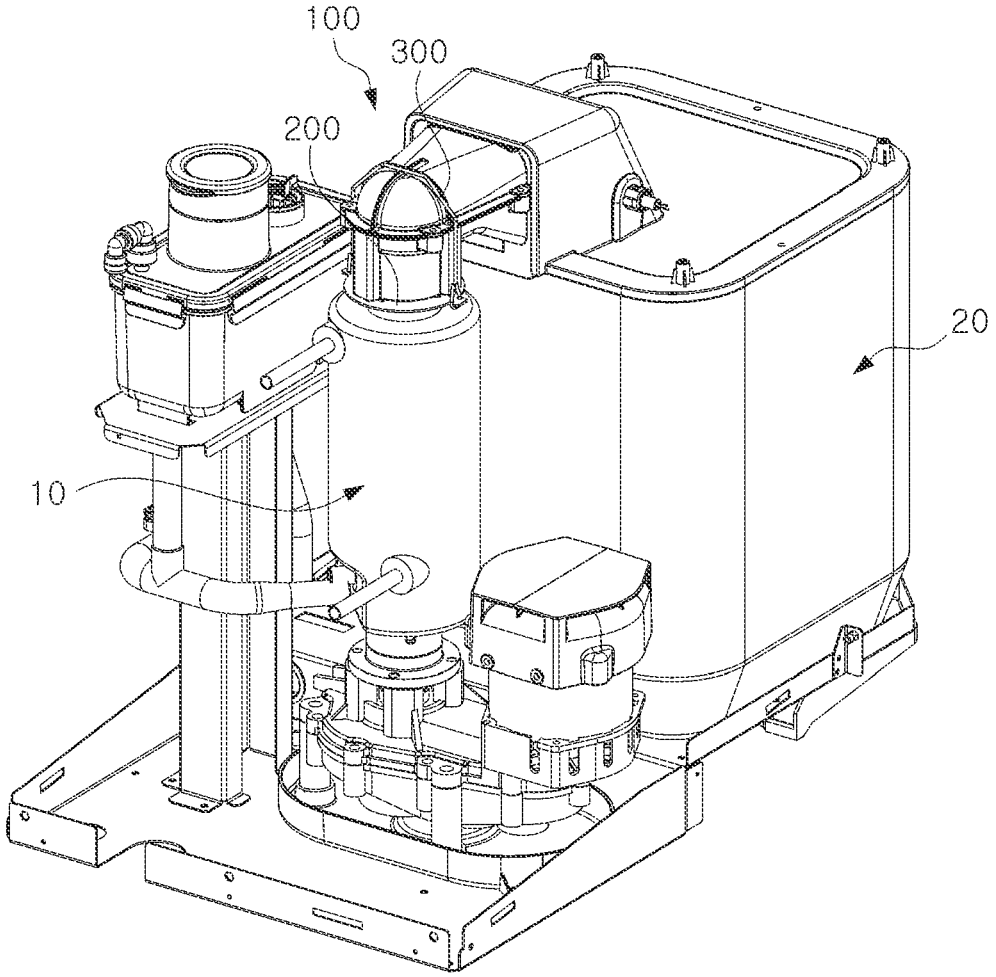
FIG. 6 is a perspective view of a nugget ice maker according to an embodiment of the present disclosure.
Figure 7:
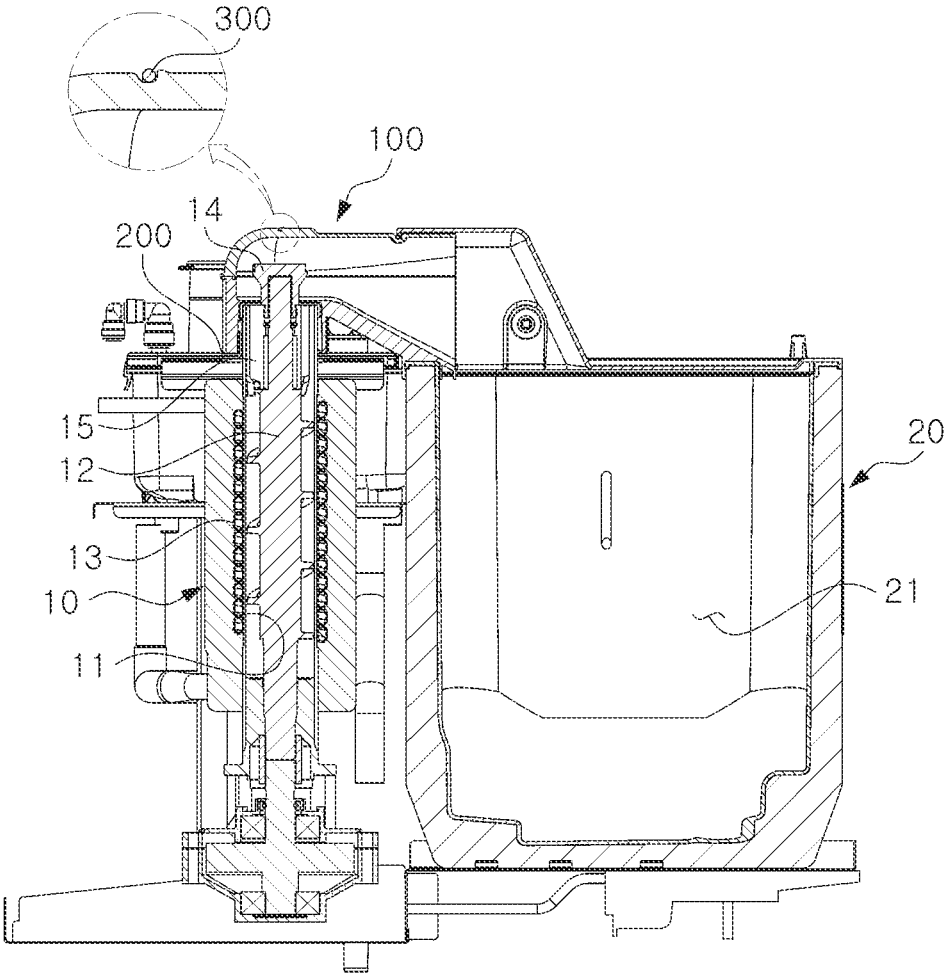
FIG. 7 is a cross-sectional view of FIG. 6.

FIGS. 6 and 7 illustrate a nugget ice maker according to an embodiment of the present disclosure. More specifically, FIG. 6 is a perspective view of a nugget ice maker according to an embodiment of the present disclosure, and FIG. 7 is a cross-sectional view of FIG. 6. Hereinafter, a nugget ice maker according to an embodiment of the present disclosure will be described with reference to FIGS. 6 and 7.

The nugget ice maker according to an embodiment of the present disclosure includes an ice producing unit 10, an ice storage unit 20, and a structure of fixing a spout according to an embodiment of the present disclosure. The ice producing unit 10 includes a hollow cylinder 11, an auger 12 provided inside the cylinder 11 coaxially with the cylinder 11, and a refrigerant formed to surround an outer peripheral surface of the cylinder 11, and ice is produced by exchanging heat with a refrigerant circulating through the refrigerant pipe 13.

The cylinder 11 may be formed of a steel pipe for piping formed of a stainless material, as the auger 12 rotates by a driving unit (not shown), ice produced inside the cylinder 11 is transferred to one end of the cylinder 11. In this case, a pressurizing head 15 pressurizing the produced ice and a cutter 14 cutting the pressurized ice into a desired size are installed at one end of the cylinder 11.

The ice storage unit 20 includes a storage space 21 in which ice is stored, and the ice cut by the cutter 14 is transferred to the storage space 21 through the spout 100 and stored. Meanwhile, the ice producing unit 10 transfers ice to one end of the cylinder 11 by rotation of the auger 12, and as the ice cut by the cutter 14 is discharged, force is applied to the spout 100.

In the nugget ice maker according to an embodiment of the present disclosure, the fixing wire 300 may fix the spout 100, and as the fixing wire 300 is separated from the seating groove 113 (see FIG. 4), the spout 100 may be easily separated. Therefore, the nugget ice maker according to an embodiment of the present disclosure is easy to fix and assemble the spout 100, and the spout 100 may be periodically separated and cleaned whenever necessary.

As set forth above, according to the present disclosure, a structure of fixing a spout facilitating fixing and assembling a spout and a nugget ice maker applying the same may be provided.

In the above, the embodiment of the present invention has been mainly described, but the present disclosure is not limited thereto and may be variously modified and implemented.

While exemplary embodiments have been shown and described above, it will be apparent to those skilled in the art that modifications and variations could be made without departing from the scope of the present invention as defined by the appended claims.

What is claimed is:

1. A structure of fixing a spout, comprising:

the spout provided between an ice maker and an ice storage, and delivering ice produced by the ice maker to the ice storage;

a flange provided on a side to which the ice maker and the spout are connected, and having locking portions, respectively convexly formed on both sides; and a fixing wire having both ends locked by the locking portion and rotating around the locking portion to fix the spout to the flange, wherein the spout comprises a cover portion fixed to be in contact with the fixing wire, wherein the cover portion comprises a first reinforcing rib protruding in a direction, parallel to the direction in contact with the fixing wire, wherein the cover portion further comprises a second reinforcing rib intersecting the first reinforcing rib, and wherein a seating groove is formed in a portion in which the first reinforcing rib and the second reinforcing rib intersect.

2. The structure of fixing a spout of claim 1, wherein the spout further comprises a passage portion coupled to the cover portion, and connecting the ice maker and the ice storage.

3. The structure of fixing a spout of claim 2, wherein the passage portion comprises:

a discharge hole formed to communicate with the ice maker, and through which ice produced by the ice maker is discharged;

a delivery hole formed to communicate with the ice storage, and delivering the ice discharged through the discharge hole toward the ice storage; and an ice delivery surface formed to be inclined downwardly from one surface of the discharge hole toward the delivery hole.

4. The structure of fixing a spout of claim 1, wherein the first reinforcing rib and the second reinforcing rib vertically intersect.

5. The structure of fixing a spout of claim 4, wherein the locking portion comprises:

a first locking protrusion formed to protrude in a radial direction of the flange; and a second locking protrusion formed to be bent from one end of the first locking protrusion.

6. The structure of fixing a spout of claim 5, wherein the fixing wire comprises a locking hole provided at both ends, and formed to surround the first locking protrusion.

7. A nugget ice maker, comprising:

the ice maker producing ice by exchanging heat with a refrigerant;

the ice storage storing ice produced by the ice maker; and the structure of fixing the spout of claim 6 connecting the ice maker and the ice storage.

8. The nugget ice maker of claim 7, wherein the ice maker comprises:

a hollow cylinder;

an auger provided inside the cylinder, coaxially with the cylinder; and a refrigerant pipe formed to surround an outer peripheral surface of the cylinder.

* * * * *